US005896665A

United States Patent [19]

Harris

[11] Patent Number: 5,896,665

[45] Date of Patent: Apr. 27, 1999

[54] SIMPLE LEVER-ACTIVATED FOLDING KNIFE

[76] Inventor: David G. Harris, 102 Sellers La., Port Matilda, Pa. 16870

[21] Appl. No.: 08/876,948

[22] Filed: Jun. 16, 1997

[51] Int. Cl.[6] ..... B26B 1/04

[52] U.S. Cl. ..... 30/160; 30/158

[58] Field of Search ..... 30/158, 159, 160

[56] References Cited

U.S. PATENT DOCUMENTS

| | | | |
|---|---|---|---|
| 533,219 | 1/1895 | Hardy | 30/158 |
| 616,689 | 12/1898 | Ruettgers | 30/158 |
| 4,177,560 | 12/1979 | Sakurai | 30/160 |
| 4,719,700 | 1/1988 | Taylor | 30/158 |
| 4,893,409 | 1/1990 | Poehlmann | 30/161 |
| 5,331,741 | 7/1994 | Taylor | 30/158 |
| 5,647,129 | 7/1997 | Stamper | 30/158 X |

*Primary Examiner*—Douglas D. Watts

[57] ABSTRACT

An improved folding knife and one-handed opening system. The key improvement consists of a manual opening lever (100) moving alongside the blade (40) operated by the thumb by pressing upwards on the thumb bar (120). Because the manual opening lever (100) rotates about the fastener-bearing (60), it can be returned to its out-of-the-way initial position after opening the knife. Thus, this invention provides a simple one-handed opening system which does not intrude into the working area of the blade.

1 Claim, 7 Drawing Sheets

SIMPLE LEVER-ACTIVATED FOLDING KNIFE

BACKGROUND OF THE INVENTION

This invention relates in general to knives, and relates in particular to a folding knife equipped with a simple lever mechanism for unfolding or opening the blade.

The traditional folding knife, sometimes also referred to as a pocket knife, has one or more blades, pivotably mounted within a housing or casement. To prevent accidental opening of the knife, each blade typically is biased in the closed position by a mechanism such as a spring or detent. To open the blade, the user must insert a thumbnail of one hand into a notch or groove provided for that purpose near the back edge of the blade, and manually rotate the blade around its pivot point at one end of the knife body while holding the body with the other hand. This opening technique can be difficult to accomplish, particularly for those having short thumbnails or for a handicapped person who may not have full use of both hands, or with knives whose blade pivot mechanism is relative stiff. Moreover, in some jobs, such as fisherman or paratrooper, it is essential to be able to open a knife with one hand while the other is otherwise occupied.

Folding knives with various mechanisms for opening or assisting with opening the blade are known in the art. For example, U.S. Pat. No. 4,177,560 discloses a knife with an action controlling the rate at which a switchblade knife opens, creating a safer one-hand opening knife. U.S. Pat. No. 4,719,700 discloses a one-hand opening knife actuated by a sliding lever interconnected with the blade via a complex set of gears. This suffers from being expensive to manufacture, and difficult to operate as the leverage factor is low. U.S. Pat. No. 4,893,409 displays a one-hand opening knife operated via button on the side which engages and disengages the blade from the handle. While this reduces opening force due to a spring or detent blade retainer, it does not allow the knife to be opened with one hand while keeping the hand in the normal operating position. This requires either using two hands, keeping the operating hand in its normal position, or rearranging ones grip on the knife for opening it. U.S. Pat. No. 5,331,741 discloses a folding knife with a lever opening the blade via a complex mechanism of gears and cams.

These arrangements all have various practical disadvantages, among which is the expense of manufacture, the fragility of the parts with respect to wear tear and the stress of opening and using the knife. Further, all require either two hands to operate, shifting the knife position to operate, or a contrary motion of the hands or fingers to operate. For example, the knife shown in U.S. Pat. No. 5,331,741 requires the thumb of the right hand (shown designed only for a right-handed person) to move away from its operating position to open the knife. Additionally, this design shows an actuation lever which, in the blade-open position, intrudes into the grip of the knife it what appears to be an uncomfortable way.

Common to the existing art is a one-hand-opening knife where a conventional folding knife design is enhanced with the provision of a button, or protrusion on the blade which permits thumb purchase and one-handed blade opening. This suffers the disadvantage of such protuberance, being permanently affixed to the blade, intruding into the working area of the knife, limiting the depth of its penetration and cut.

SUMMARY OF THE INVENTION

In general terms, a folding knife according to the present invention has a knife blade mounted in a body for pivotable movement between the closed and open positions, in response to the operation of a manual actuation lever. The lever is mounted in the body of the knife, along a plane parallel to the blade, and, in the preferred embodiment, located next to the blade and positioned for one-handed operation by the thumb of the gripping hand. The lever pivots around the same axis as the blade. The actuation lever is coupled with the blade via a pin attached to the actuating lever and extending into a corresponding notch in the blade such that lifting the lever lifts the blade through the same arc of motion. The pin is constrained in its upward—opening—motion by the blade, but is free to return to its initial position. This permits opening the blade by moving the lever, and also permits returning the lever to its initial, out-of-the-way, position after opening the knife. This return of the lever to its initial position is a great improvement over the current button design as, after its return, the opening mechanism no longer intrudes into the working area of he knife.

BRIEF DESCRIPTION OF DRAWINGS

These and other objects, features and advantages of the invention will be more readily apparent from the following drawings and accompanying detailed description of a preferred embodiment of the invention in which.

DETAILED DESCRIPTION OF PREFERRED EMBODIMENT

Figure 1:
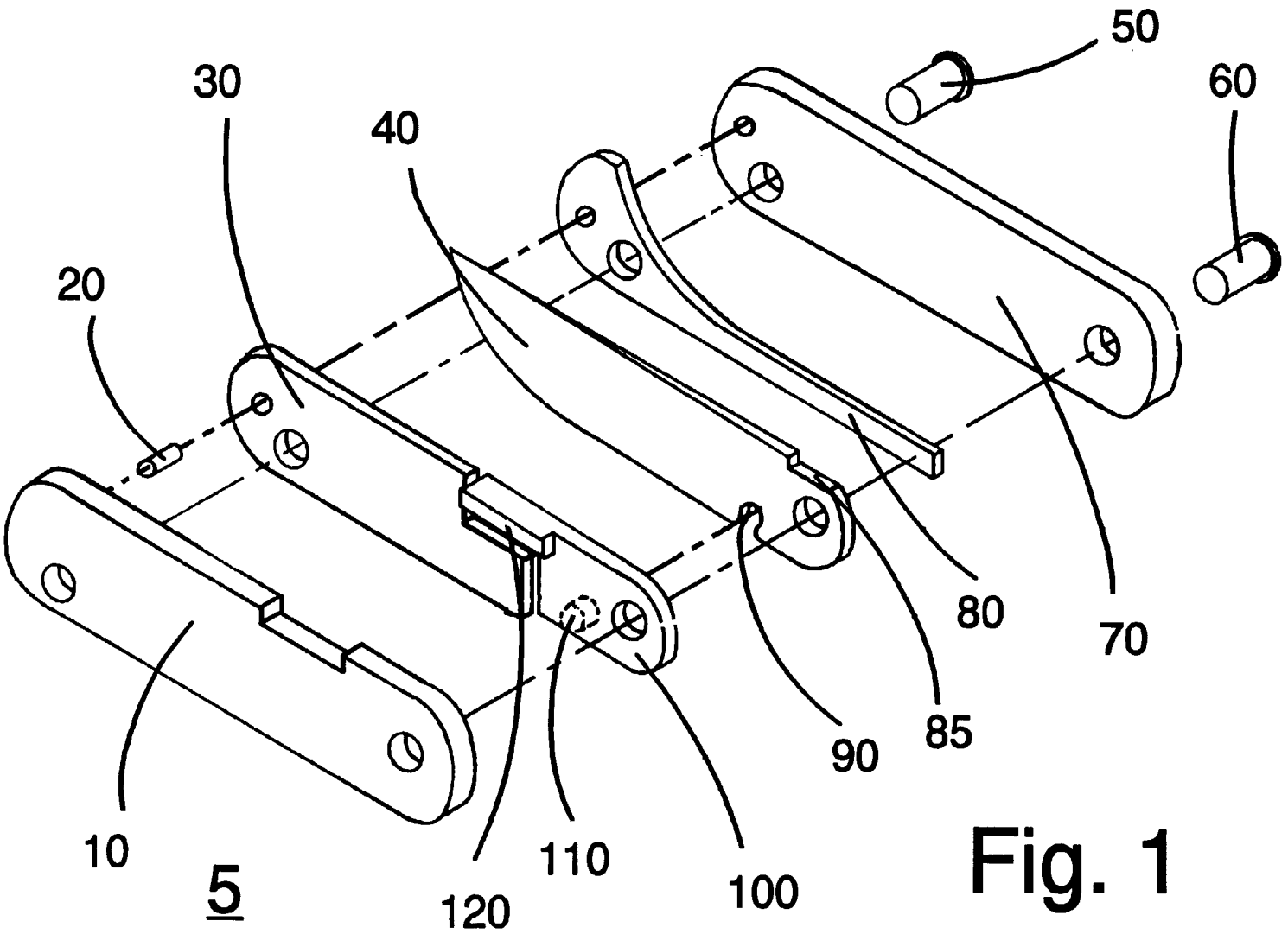
FIG. 1 is a perspective view of a preferred embodiment of the invention.
Figure 2:
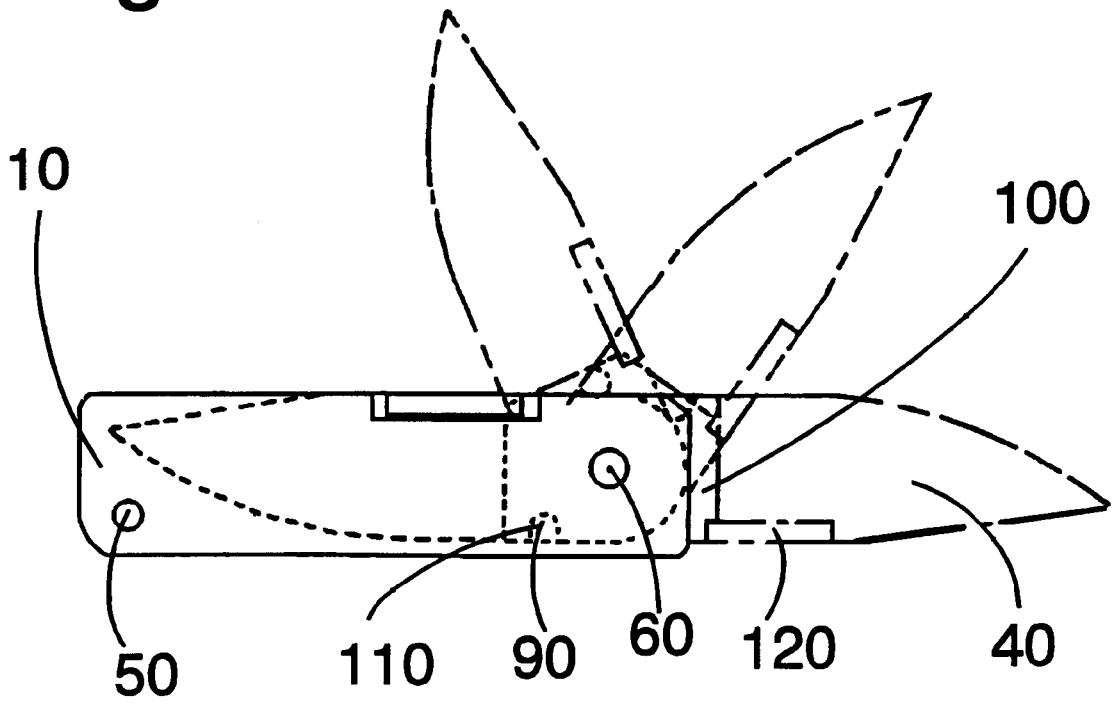
FIG. 2 is a side view of the preferred embodiment opening.
Figure 3:
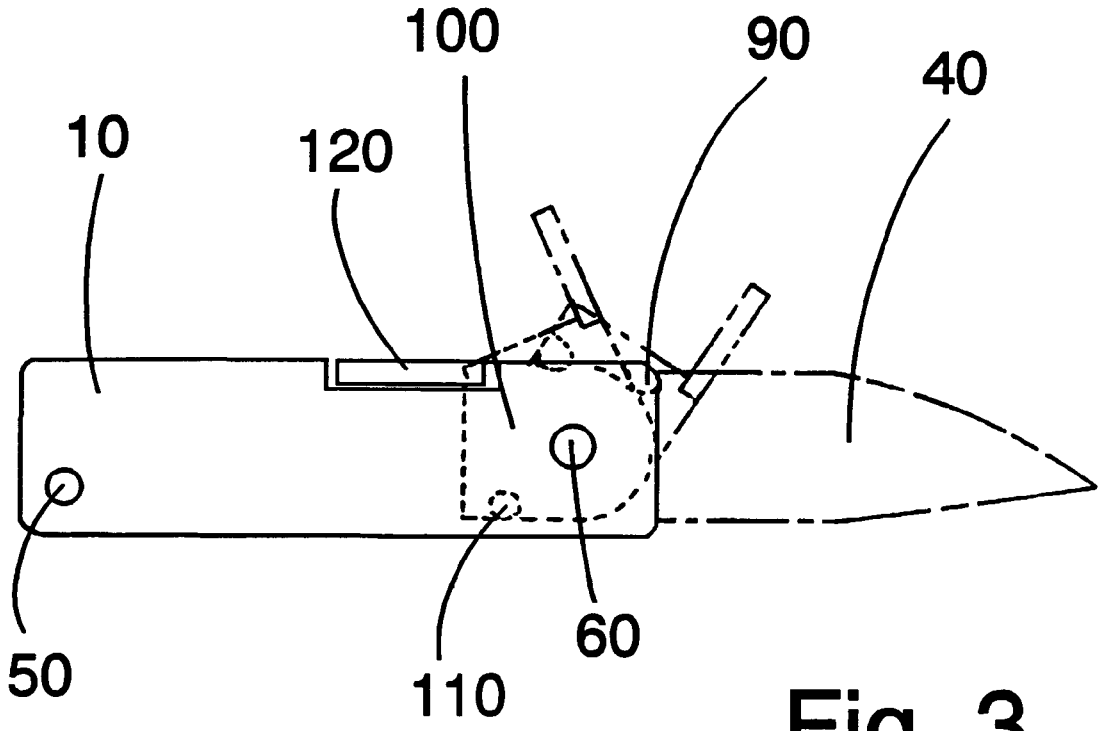
FIG. 3 is a side view of the preferred embodiment after opening with the actuating lever returning to rest.

Turning to FIGS. 1–3, there is shown generally a lever actuated folding knife 5 having a body consisting of scales, 10, 70 within which a blade 40 is pivotably attached via the fastener-bearing 60. The blade 40 is movable from its resting position to a fully open position in which the blade is rotated nearly 180 degrees to extend nearly parallel with the longitudinal axis of the body 10, 70, as shown in FIGS. 2–3. The blade is moved from its closed to its open position by means of an actuating lever 100 by means of finger pressure on its thumb bar 120, which projecting past the body 10 allows access for the thumb. The travel of the blade 40 is halted by the action of the back spring 80 upon its engagement with the notch 85 on the back of the blade 40. Also, the spring provides tension, preventing the blade 40 from returning to the closed position under gravitational or other light pressure. Manual closure is required.

More particularly, pressure on the thumb bar 120 rotates the lever 100 around the fastener-bearing 60. The pin 110 protruding from the lever 100 and into a corresponding recess 90 in the blade 40 presses upon the blade 40, lifting it as the lever 100 is rotated through the arc of its travel. Upon full opening the blade 40 is held in position by friction from the back spring 80 and the engagement of the back spring 80 with the notch 85 on the back of the blade 40. FIG. 2 shows the actuating lever 100 rotating and lifting the blade 40 into its open position. FIG. 3 shows the return of the actuating lever 100 after opening the blade.

Individual components of the knife 5 and the physical interrelation of those components is best understood with reference to FIG. 1, the exploded, perspective view. The body of the knife 5 is comprised of a front scale 10, and a back scale 70 that are secured together in assembly by a fastener 50 and a fastener-bearing 60, or the like. A spacer portion 30 maintains the distance between the body and the blade and supports the lever 100. The back spring 80 provides tension for maintaining the knife in a closed position until acted upon by the lever 100, restrains the angle of the blade opening, provides tension to keep the knife open, and spaces the back scale 70 from the lever 100 and the spacer 30 so that the blade may rotate properly. The fastening pin 20 locates the back spring 80 and the spacer 30 within the body of the knife.

The key to this invention is the provision of a simple lever acted upon by the thumb and, in turn, acting upon the blade of the knife, and a means by which such lever may be rotated back, away from the open blade where it will not interfere with gripping and using the knife. While for clarity of presentation the actuating lever is shown as manually retractable, it can also be connected to a spring such that, after opening the blade, releasing pressure on the thumb bar 120 allows the spring to return the actuating lever to its initial rest position.

Figure 4:
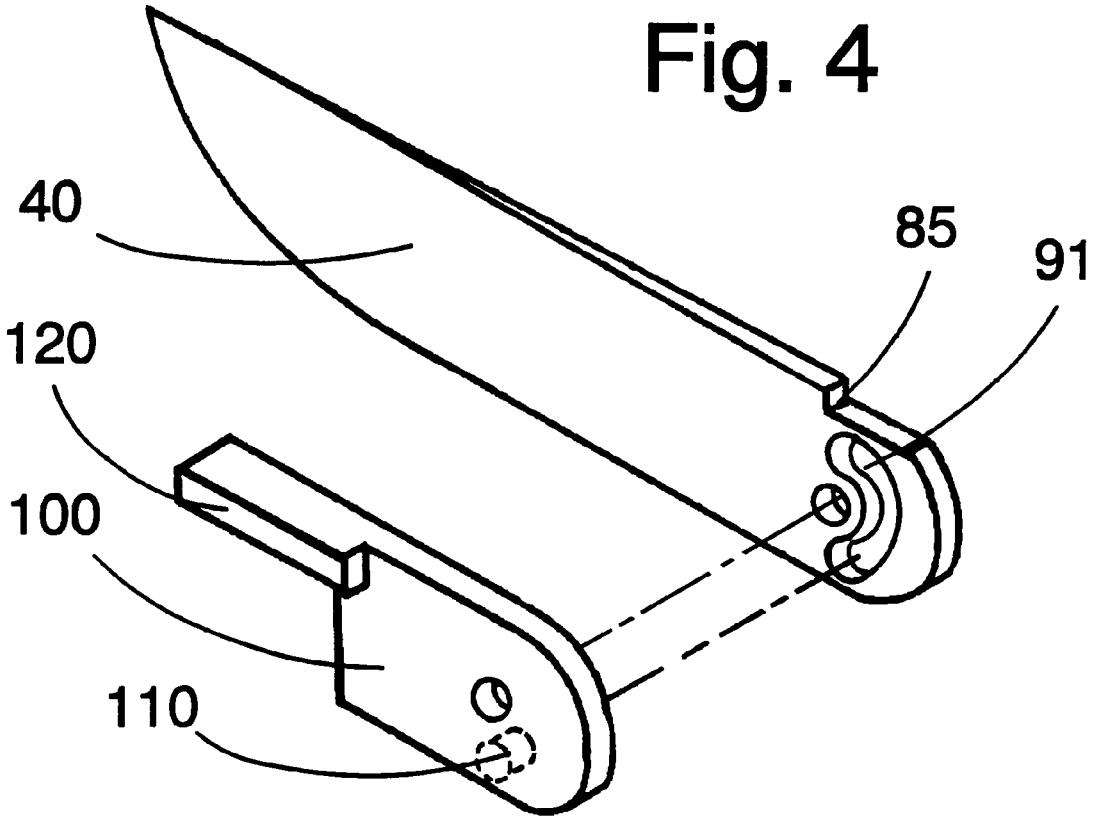
FIG. 4 is a perspective view of the first embodiment.
Figure 5:
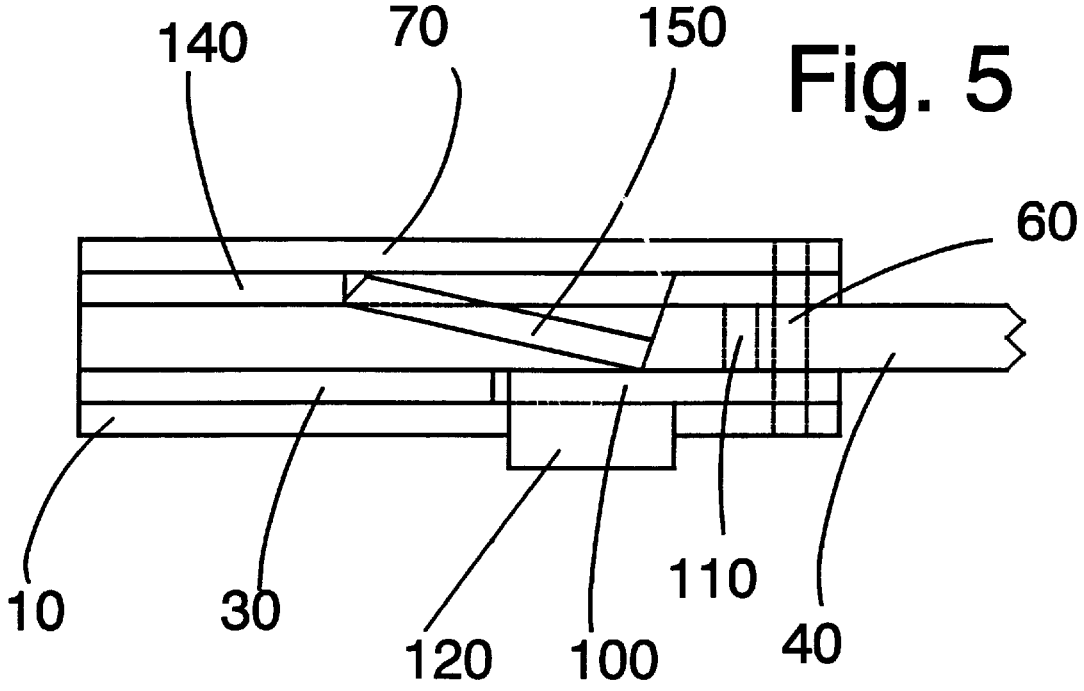
FIG. 5 is a top view of the second embodiment.

While in the preferred embodiment the actuating lever 100 is shown acting upon a notch 90 on the front side of the blade 40, it can also act upon a slot located in the interior of the blade. In FIG. 4 the addition of a semi-circular slot 91 cut in the blade 40 permits the pin 110 to lift the knife without, itself, being exposed. Though more expensive to manufacture, this may facilitate the reliability of the action by excluding dirt and debris. Also, this modification permits the lifting mechanism described herein to be used with a wider variety of blade locking mechanisms. While the preferred embodiment described herein can be used with the commonly seen lock-blade knife design which replaces the spring back 80 with a locking back spring as commonly found in the current art, the alternative shown in FIG. 4 can also be used with a liner lock. FIG. 5 is a top-view of a design showing the modification of FIG. 4 in conjunction with a liner lock. The inner liner, or spacer 140 has a hinged or bent portion 150 which is held within the liner 140 by the blade when the blade 40 is in the closed position. On opening, it springs into the space formerly occupied by the blade 40, locking the blade 40 in its open position. The modified actuating lever 100 can still be returned to rest even with the liner lock 150 in its operating position, whereas the preferred embodiment could not.

Figure 6:
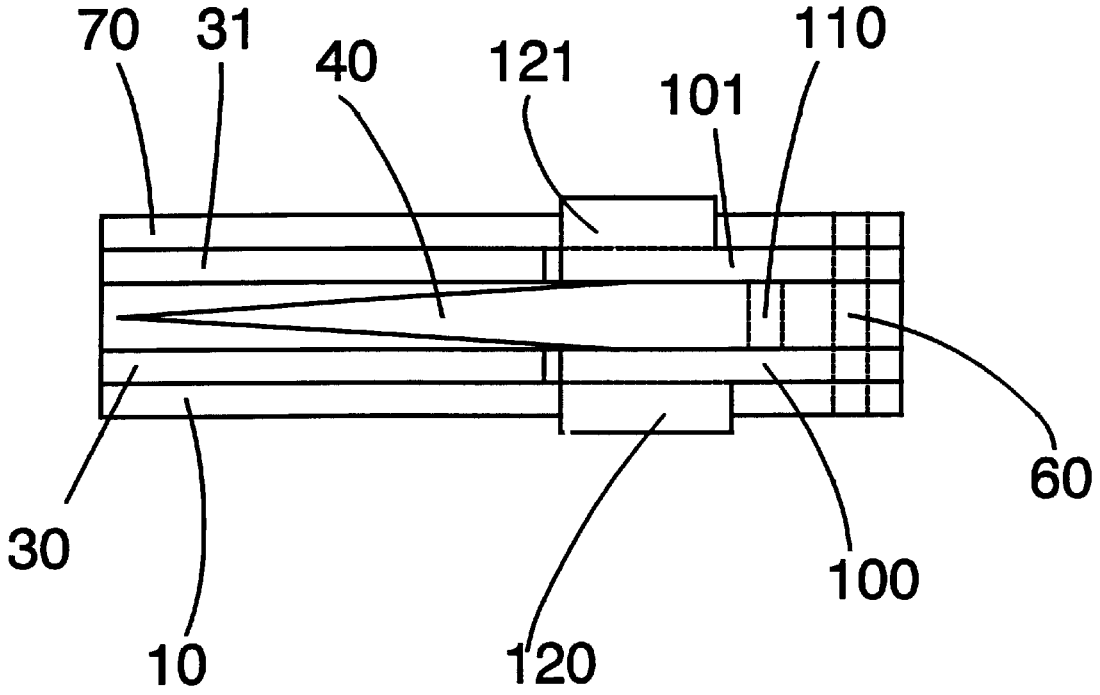
FIG. 6 is a top view of the third embodiment.

While in the preferred embodiment the actuating lever is shown operable by only one hand, the right hand, it can, unlike much prior art, easily be modified to allow for one-handed unfolding with either hand. FIG. 6 shows a top-view of such an either-handed design. Either-handedness is effectuated by the addition of an additional actuating lever 101 with an associated thumb bar for the left thumb 121 and an additional spacer 31. The left-hand actuating lever is shown connected to the right-hand actuating lever via an extended pin 110, which, in this embodiment, is lengthened to pass across or through the blade 40 and into the left-hand actuating lever 101. While in FIG. 4 the actuating levers 100, 101 are shown connected, they need not be. They can each be affixed with a pin, corresponding to 110, but acting on the blade at slightly different locations, and allowing for independent action.

Figure 7:
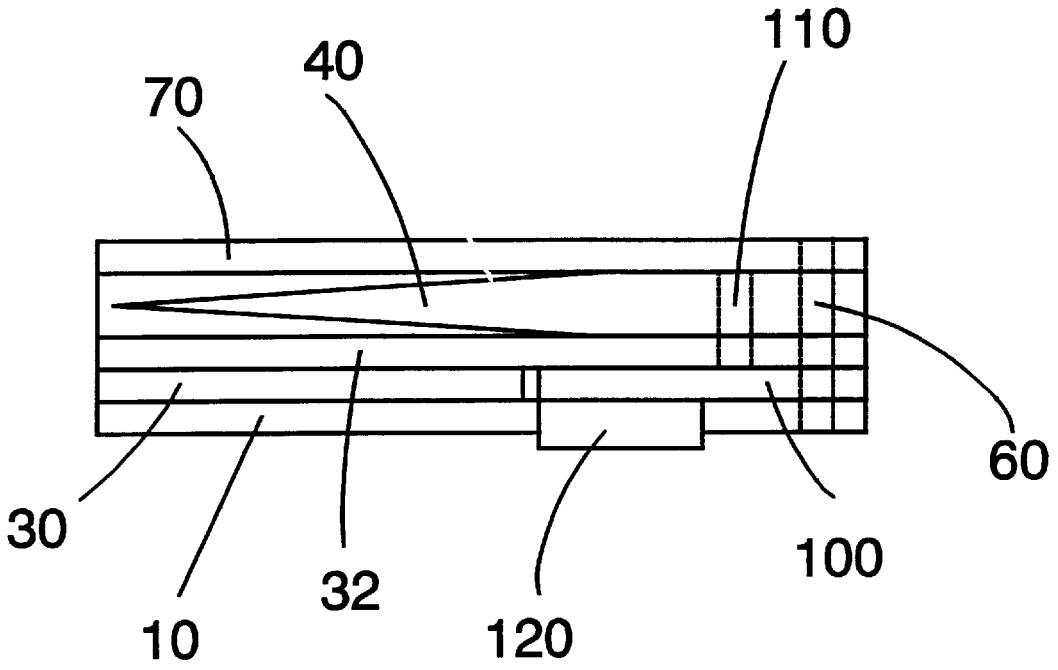
FIG. 7 is a top view of the fourth embodiment.

While in the preferred embodiment the actuating lever is shown placed next to the blade, if desired, as shown in FIG. 7, a supporting scale 32 can be placed between the actuating lever 100 and the blade 40 to strengthen the knife design. If so, then the lengthened pin 110 would pass through the additional supporting scale 32 via a slot similar to that shown in FIG. 4 91 and act on the blade 40.

Finally, while in the preferred embodiment the actuating lever is shown rotating about the same axis as the blade it need not do so. If, for example, the pivot point of the actuating lever were moved to a point between the blade pivot point 60 and the notch 90 in the blade 40 engaged by the pin 110 then its 180 degree arc of motion would be shorter than that of the blade. Depending on the shape of the notch and the position of the pivot point of the actuating lever, various camming effects can be achieved increasing (decreasing) the opening (closing) effort, etc.

Although the description above contains many specificities, these should not be construed as limiting the scope of the invention but as merely providing illustrations of some of the presently preferred embodiments of this invention. The common thread, and the focus of this invention is the provision of an actuating lever for simply and easily opening a folding knife's blade while providing for the lever's return to the knife body, out of the way of using and handling the knife.

As will be apparent to those skilled in the art, numerous modifications may be made within the spirit and scope of the above described invention.

I claim:

1. A folding knife comprising an elongated blade having a cutting edge; a body to hold the blade for pivotal movement between a closed and an open position; a manual actuation blade opening lever which pivots about the same axis as the blade, operatively interconnected with the blade so that operation of the lever moves the blade into its fully-open position; said manual actuation blade opening lever so operatively interconnected with said blade and the body of the knife that after moving the blade into its open position said manual actuation blade opening lever can independently be returned to its initial position leaving the blade fully open in its operational position and the knife fully prepared for normal use.

* * * * *